US009328457B2

(12) United States Patent
Barbier et al.

(10) Patent No.: US 9,328,457 B2
(45) Date of Patent: May 3, 2016

(54) PROCESS FOR THE PRODUCTION OF AN INTERMEDIATE PRODUCT INTENDED FOR THE PRODUCTION OF ETHANOL AND FOR THE PRODUCTION OF LIGNIN

(71) Applicant: VALAGRO CARBONE RENOUVELABLE POITOU-CHARENTES, Poitiers (FR)

(72) Inventors: Jacques Barbier, Montamise (FR); Frederic Bataille, Sevres-Anxaumont (FR); Alexandre Briand, Saint Cyr (FR); Stephane Soum, Migne-Auxances (FR)

(73) Assignee: VALAGRO CARBONE RENOUVELABLE POITOU-CHARENTES, Poitiers (FR)

( * ) Notice: Subject to any disclaimer, the term of this patent is extended or adjusted under 35 U.S.C. 154(b) by 0 days.

(21) Appl. No.: 14/482,208

(22) Filed: Sep. 10, 2014

(65) Prior Publication Data

US 2014/0374040 A1 Dec. 25, 2014

Related U.S. Application Data

(63) Continuation-in-part of application No. 13/133,059, filed as application No. PCT/FR2009/052416 on Dec. 4, 2009, now abandoned.

(30) Foreign Application Priority Data

Dec. 5, 2008 (FR) ..... 08 58306

(51) Int. Cl.

| | |
|---|---|
| ***D21C 1/06*** | (2006.01) |
| ***D21C 3/02*** | (2006.01) |
| ***D21C 3/00*** | (2006.01) |
| ***D21C 11/00*** | (2006.01) |
| *C10L 1/02* | (2006.01) |

(52) U.S. Cl.

CPC .. *D21C 3/00* (2013.01); *D21C 1/06* (2013.01); *D21C 3/02* (2013.01); *D21C 11/0007* (2013.01); *C10L 1/02* (2013.01); *C10L 2290/141* (2013.01); *C10L 2290/146* (2013.01); *C10L 2290/24* (2013.01); *C10L 2290/26* (2013.01); *C10L 2290/50* (2013.01)

(58) Field of Classification Search

CPC ..... D21C 3/00; D21C 1/08; D21C 3/02; D21C 1/06; C10L 1/02

USPC ..... 162/24, 26, 90

See application file for complete search history.

(56) References Cited

U.S. PATENT DOCUMENTS

| | | | |
|---|---|---|---|
| 2,745,321 | A | 5/1956 | Bowers |
| 4,642,287 | A | 2/1987 | Inoi et al. |
| 4,652,341 | A | 3/1987 | Prior |
| 4,790,905 | A | 12/1988 | Nivelleau de La Bruniere et al. |
| 4,904,342 | A | 2/1990 | Arnoldy et al. |
| 6,090,595 | A | 7/2000 | Foody et al. |

*Primary Examiner* — Anthony Calandra

(74) *Attorney, Agent, or Firm* — Young & Thompson

(57) ABSTRACT

A process for producing from a lignocellulosic raw material of (i) an intermediate product that is intended for the production of ethanol, containing polysaccharides, cellulose and hemicelluloses, and (ii) a product containing lignin in an aqueous solution without sulfur residue, this lignin could be precipitated. The process includes a step of pulping the raw material in an extruder at a temperature of between 60° C. and 180° C. and in the presence of a quantity of water that represents between 200% and 450% of the mass of said raw material and in the presence of a strong base at a concentration of between 0.5% and 4% relative to the volume of water.

5 Claims, No Drawings

PROCESS FOR THE PRODUCTION OF AN INTERMEDIATE PRODUCT INTENDED FOR THE PRODUCTION OF ETHANOL AND FOR THE PRODUCTION OF LIGNIN

FIELD OF THE INVENTION

This invention relates to a process for the production of an intermediate product that is intended for the production of ethanol, starting from a lignocellulosic raw material.

The invention also relates to the intermediate product that is obtained by this process and its use for producing ethanol.

BACKGROUND OF THE INVENTION

For several years, numerous studies have been conducted for replacing fossil energy sources by renewable energies. In particular, research has been oriented toward the creation of new fuels: agrofuels or ecofuels.

An ecofuel is a fuel that is produced from renewable organic materials of non-fossil origin.

There are various techniques for production of ecofuels, in particular the production of oil, alcohol, or gas fuels from plant or animal biomass, or industrial or community waste.

Currently, numerous agrofuels are being developed in the form of ethanol from fermentation of sugars originating from grains, wheat or corn, or beet scraps.

However, the development of these agrofuels poses significant problems, in particular because they compete directly with food cultivation and the production capacity of raw materials is limited compared to the very significant quantities of fuels that are consumed. It is estimated that only approximately 10% of the requirements could be met by this line.

In contrast, the available quantity of lignocellulosic compounds is very large and represents a potential of 40% of the fuel demand.

These lignocellulosic compounds comprise in particular wood, straw, plants originating from dedicated crops having a high level of dry material, agricultural co-products, collected plant wastes, and industrial or community waste.

The lignocellulosic biomass essentially consists of polysaccharides of cellulose and hemicelluloses, strongly linked to a lignin by covalent bond and hydrogen bond.

The production of ethanol from lignocellulosic compounds is done by hydrolysis of cellulose into molecules of glucose, simple sugars that are then fermented into ethanol by means of glycolysis. It requires a pretreatment for making cellulose accessible so as to facilitate its enzymatic hydrolysis.

In the known processes, lignocellulosic biomass is pretreated chemically for hydrolyzing hemicelluloses and making cellulose accessible.

In general, it involves a pretreatment by hydrolysis in a hot basic medium of the biomass for solubilizing hemicelluloses and a portion of lignin or in a hot weak acid medium for hydrolyzing hemicelluloses.

However, these known pretreatment methods are not satisfactory in terms of yield and require the use of concentrated products.

SUMMARY OF THE INVENTION

This is why this invention proposes eliminating the drawbacks of the prior art by proposing an effective and economical process for pretreatment of a lignocellulosic biomass for the purpose of its transformation into ethanol. For this purpose, the invention has as its object a process for the production from a lignocellulosic raw material of:

- an intermediate product that is intended for the production of ethanol, containing polysaccharides, cellulose and hemicelluloses, and
- a product containing lignin in an aqueous solution without sulfur residue, this lignin could be precipitated, characterized in that it consists in pulping said raw material in an extruder at a temperature of between 60° C. and 180° C. and in the presence of:

- a quantity of water that represents between 200% and 450% of the mass of said raw material and
- a strong base at a concentration of between 0.5% and 4% relative to the volume of water.

The intermediate product in terms of this invention is defined as the biomass that is obtained after pulping. It is an intermediate product that is intended for the production of ethanol. It contains in particular polysaccharides, cellulose, and hemicelluloses.

The product containing lignin is a product containing soluble lignin in an aqueous solution without sulfur residue. This lignin can be precipitated. Advantageously, the process according to the invention makes it possible to obtain an intermediate product that makes it possible to increase by a factor of 8 the yield of the enzymatic hydrolysis of cellulose, and therefore the yield of ethanol production. More the product containing lignin does not contain a sulfur residue and the lignin can be precipitated.

DETAILED DESCRIPTION OF THE INVENTION

The invention is now described in detail.

The object of the invention is a process for pretreatment of a lignocellulosic biomass for producing:

- an intermediate product that is intended for the production of ethanol, containing polysaccharides, cellulose and hemicelluloses, and
- a product containing lignin in an aqueous solution without sulfur residue, this lignin could be precipitated, Lignocellulosic raw material or lignocellulosic biomass in terms of the invention is defined as any lignocellulosic compound, in particular:

- Natural plant fibers, for example hemp or linen,
- Energy crops, for example Miscanthus, switchgrass, willow, and poplar,
- Agricultural co-products, such as straw of any type (grains, oleaginous plants, etc.), vine shoots, grain husks, sunflower heads, and corn stalks,
- Co-products of the forest, for example shredded wood,
- Subsidiary products of the wood industry, for example sawdust or barks,
- Industrial waste, for example textile cotton, paper, products at the end of their service life (pallets, crossties, railroad tracks, etc.), or scraps of pressboard panels.

The process according to the invention consists in pulping the lignocellulosic raw material or biomass in an extruder at a temperature of between 60° C. and 180° C. and in the presence of a quantity of water that represents between 200% and 450% of the mass of said raw material, and of a strong base at a concentration that is between 0.5% and 4% relative to the volume of water.

An extruder is a device that consists primarily of one or more endless screws turning at a determined speed inside a temperature-regulated cylindrical case.

Preferably, the process according to the invention uses a single-screw or twin-screw extruder.

A twin-screw extruder is an extruder that consists of two cooperating screws that turn in the same direction and a case that envelops these two screws. The two screws are identical and consist of modules that comprise a material-conveying element that is equipped with windows or slots cut into the threads.

Advantageously, the extruder makes it possible in a single stage to execute one or more operation(s), in particular the pulping of the lignocellulosic biomass by the combination of compression and shearing actions that makes it possible to separate the fibers and to release the cellulose by freeing it from the lignin network, and the solubilization of the hemicelluloses.

According to the invention, the temperature of the extruder is between 60° C. and 180° C., preferably between 90° C. and 120° C., and even more preferably between 100° C. and 110° C.

Furthermore, the quantity of water that is used in the extruder is between 200% and 450% of the mass of said lignocellulosic raw material, preferably between 300% and 450%, and even more preferably between 300% and 400%, of the mass of the lignocellulosic raw material.

The quantity of a strong base is between 0.5% and 4% relative to the volume of water, preferably between 0.5 and 1.5%, and even more preferably between 0.8% and 1.2%. It may involve, for example, sodium hydroxide, or potassium hydroxide. The combination of these parameters, temperature, quantity of water and/or quantity of particular strong base makes it possible to obtain a lignocellulosic intermediate product that can be hydrolyzed at a particularly high rate.

The use of a strong base is very important because the lignin is completely removed after the pressing step. The pressing allows the separation of the solubilized lignin and polysaccharides, cellulose, and hemicelluloses.

The products obtained are different from those obtained in the known processes because there is no sulfur with the solubilized lignin in aqueous solution.

An example of a particularly suitable process according to the invention comprises the following stages:

- Mixing the lignocellulosic raw material with a quantity of water that represents 200% of its mass, preferably in the presence of a strong acid (sulfuric acid, $H_2SO_4$), or a strong base (sodium hydroxide, NaOH) that is concentrated at 1% relative to the quantity of water,
- Introducing this mixture into an extruder at a pulping temperature of between 60° C. and 180° C.,
- Adding a quantity of water that represents between 0% and 200% of the mass of said lignocellulosic raw material into the extruder case during the extrusion phase.

Tests have been carried out by executing this process by varying the parameters of temperature, quantity of water, and the presence or absence of a strong acid or a strong base.

Two grams of the intermediate product obtained were then hydrolyzed in 50 ml per 5 ml of cellulases (*Trichoderma longibrachiatum*) at pH 5 and 50° C.

The results that are obtained are presented in the table below:

| Treatment of the Biomass | % of Hydrolysis of the Intermediate Product |
|---|---|
| None (Control) | 7.96 |
| 60° C. | 6.99 |
| 200% Water - 60° C. | 14.75 |
| 300% Water - 60° C. | 17.97 |
| 400% Water - 60° C. | 19.97 |
| 200% Water - 105° C. | 17.94 |
| 300% Water - 105° C. | 21.99 |
| 400% Water - 105° C. | 21.94 |
| 200% Water - 130° C. | 16.96 |
| 300% Water - 130° C. | 14.94 |
| 400% Water - 130° C. | 16.93 |
| 200% Water - 180° C. | 10.98 |
| 300% Water - 180° C. | 14.94 |
| 400% Water - 60° C. | 14.99 |
| 400% Water with 1% $H_2SO_4$ - 105° C. | 44.0 |
| 400% Water with 1% $H_2SO_4$ - 120° C. | 40.1 |

-continued

| Treatment of the Biomass | % of Hydrolysis of the Intermediate Product |
|---|---|
| 400% Water with 1% $H_2SO_4$ - 140° C. | 38.4 |
| 200% Water with 1% $H_2SO_4$ - 170° C. | 31.4 |
| 400% Water with 1% NaOH - 105° C. | 53.4 |
| 400% Water with 1% NaOH - 120° C. | 58.4 |
| 200% Water with 1% NaOH - 140° C. | 56.1 |
| 300% Water with 1% NaOH - 170° C. | 49.8 |

It is noted that for the range of values of water quantity, temperature and/or concentration or strong base according to the invention, the hydrolysis yield is very greatly increased. The use of a strong base is also better than the use of a strong acid in the same experimental conditions.

The optimized conditions of the process according to the invention are an extrusion temperature of 120° C. and a quantity of water of 400% (200% premixed with the biomass and 200% directly into the case of the extruder) and 1% of a strong base.

The execution of the process according to the invention under these conditions can make it possible to increase by a factor of 8 the yield of the enzymatic hydrolysis of the treated biomass.

According to the invention, any lignocellulosic material can be used.

A particularly suitable variant consists in using recycled textile cotton, in particular recycled textile cotton that consists of at least 90% cellulose that makes it possible also to increase the yields, as a raw material. A recycled textile cotton that consists of 92-93% cellulose, treated by the execution of the process according to the invention at 105° C. and a quantity of water of 300%, makes it possible to obtain a gain of hydrolysis of 23%.

According to another aspect, the invention relates to the intermediate product that is obtained by the execution of the process according to the invention.

It involves a treated lignocellulosic biomass that can advantageously be used for producing ethanol by the execution of any suitable process. A preferred process comprises the following stages:

- Enzymatic hydrolysis of the intermediate product,
- Reverse osmosis, ultrafiltration, nanofiltration, discoloration and/or sterile filtration,
- Fermentation, and
- Distillation/dehydration.

Preferably, it comprises the following stages:

- Enzymatic hydrolysis using an enzymatic cocktail that consists of cellulases and β-glucosidase (between 0.1 and 0.3 g of enzyme per gram of cellulose) in a tank that is kept at a temperature of between 45° C. and 55° C., at a pH of between 4 and 5.5 for at least 15 hours,
- Centrifuging,
- Ultrafiltration for recycling the enzymes of the hydrolysis,
- Reverse osmosis,
- Sterile filtration,
- Cooling,
- Fermentation in a fermenter at approximately 30° C., between 7 hours and 24 hours, at a pH of between 3.8 and 4.3, with *Saccharomyces cerevisiae*, and
- Distillation/dehydration.

Such a process makes it possible to produce significant yields of bioethanol, in particular using an intermediate product, lignocellulosic biomass that is treated by the process according to the invention.

The ethanol that is obtained can advantageously be used as a fuel in a gasoline-powered vehicle, alone or combined with one or more other fuels.

Moreover, the process allows to obtain a product containing lignin that can be used for energy construction materials (resins, adhesives), and special chemicals (vanillin, etc.)

This lignin product is characterized by the following characteristics:

TABLE 1

Chemical analysis of organic matter

| | NMR, $^{31}P$, phosphorylating agentTMDP* | | | |
|---|---|---|---|---|
| | —OH aromatic, % | —OH aliphatic, % | —COOH, % | —$OCH_3$, % |
| organic material composition | 0.7 | 12.7 | 18.7 | 5.3 |

*OM: Organic Matter

*TMDP: 2-chloro-4,4,5,5-tetramethyl-1,3,2-dioxaphospholane

TABLE 2

Operating conditions of the DTA/TGA

| parameters | Unit | values |
|---|---|---|
| maximum temperature | ° C. | 1100 |
| speed | ° C./min | 10 |
| At T max | min | 1 |
| atmosphere | — | Air or Argon |

Results:

TABLE 3

Results of the DTA/TGA

| | Atmosphere | |
|---|---|---|
| Mass loss between | Air | Nitrogen |
| T ° C. ambient-150° C. (=Water contained in the sample), % | 9.8 | 8.0 |
| T ° C. 150° C.-200° C., % | 3.2 | 2.9 |

The invention claimed is:

1. A process for producing from a lignocellulosic raw material of:

(i) an intermediate product that is intended for the production of ethanol, containing polysaccharides, cellulose and hemicelluloses, and (ii) a product containing lignin in an aqueous solution without sulfur residue, this lignin could be precipitated, said process comprising:

mixing said raw material with a first quantity of water and a strong base at a concentration of between 0.5% and 4% relative to the volume of said first quantity of water to form a mixture; and introducing said mixture and a second quantity of water excluding a strong base into an extruder and pulping said mixture and said second quantity in said extruder at a temperature of between 90° C. and 120° C., wherein said first quantity and said second quantity of water represent between 300% and 400% of the mass of said raw material.

2. The process according to claim 1 wherein the concentration of strong base relative to the volume of said first quantity of water is between 0.5 and 1.5%.

3. The process according to claim 1, wherein the temperature is between 100° C. and 110° C.

4. The process according to claim 1, wherein the lignocellulosic raw material is pulped in a twin-screw extruder.

5. The process according to claim 1, wherein:

said first quantity of water mixed with said raw material represents 200% of the mass of said raw material, and said strong base mixed with said raw material is concentrated at 1% relative to the volume of water, the mixture introduced into said extruder is at a temperature of 105° C., and said second quantity of water excluding a strong base introduced into said extruder with said mixture represents between 100% and 200% of the mass of said raw material.

* * * * *